US008220429B2

(12) United States Patent
Schneiker

(10) Patent No.: US 8,220,429 B2
(45) Date of Patent: Jul. 17, 2012

(54) OVERHEAD VALVE AND ROCKER ARM CONFIGURATION FOR A SMALL ENGINE

(75) Inventor: John R. Schneiker, Muskego, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 442 days.

(21) Appl. No.: 12/508,288

(22) Filed: Jul. 23, 2009

(65) Prior Publication Data

US 2011/0017159 A1 Jan. 27, 2011

(51) Int. Cl.
*F01L 1/18* (2006.01)

(52) U.S. Cl. ..... 123/90.39; 123/90.16; 123/90.44; 123/90.61; 123/193.5

(58) Field of Classification Search ..... 123/90.39, 123/90.44, 90.16, 90.61, 193.5
See application file for complete search history.

(56) References Cited

U.S. PATENT DOCUMENTS

| | | | |
|---|---|---|---|
| 2,609,805 | A | 9/1952 | Pescara |
| 2,957,461 | A | 10/1960 | Carpentier et al. |
| 2,963,010 | A | 12/1960 | Payne |
| 3,428,032 | A | 2/1969 | Rudert |
| 4,425,881 | A | 1/1984 | Lyndhurst |
| 4,773,361 | A | 9/1988 | Toki et al. |
| 5,291,868 | A | 3/1994 | Nonogawa et al. |
| 5,535,710 | A | 7/1996 | Zoschke et al. |
| 5,564,374 | A | 10/1996 | Hoffman et al. |
| 5,596,958 | A | 1/1997 | Miller |
| 5,636,600 | A | 6/1997 | Sweetland et al. |
| 5,671,709 | A | 9/1997 | Sokoloski |
| 6,205,966 | B1 | 3/2001 | Breitenberger |
| 6,273,043 | B1 | 8/2001 | Barton |
| 6,484,682 | B2 | 11/2002 | Danesh et al. |
| 6,484,683 | B2 | 11/2002 | Zielke |
| 6,505,589 | B1 | 1/2003 | Hayman et al. |
| 6,546,905 | B2 | 4/2003 | Durr et al. |
| 6,659,056 | B2 | 12/2003 | Sweetland |
| 6,851,403 | B2 | 2/2005 | Durr et al. |
| 6,952,056 | B2 | 10/2005 | Brandenburg et al. |
| 6,975,216 | B2 | 12/2005 | Tharman et al. |
| 6,998,725 | B2 | 2/2006 | Brandenburg et al. |

(Continued)

FOREIGN PATENT DOCUMENTS

EP 0 887 520 A1 12/1998

(Continued)

OTHER PUBLICATIONS

Invitation to Pay Additional Fees and Related Search Report for PCT Application No. PCT/US2010/042045, dated Nov. 22, 2010, 5 pages.

(Continued)

*Primary Examiner* — Ching Chang
(74) *Attorney, Agent, or Firm* — Foley & Lardner LLP

(57) ABSTRACT

A single-cylinder, four-stroke cycle, internal combustion engine arranged in an overhead valve configuration includes a first valve train and a second valve train. The first valve train includes a first cam on a camshaft, a first pushrod driven by the first cam, a first rocker arm attached to the first pushrod, and an exhaust valve driven by the first rocker arm. The second valve train includes a second cam on the camshaft, a second pushrod driven by the second cam, a second rocker arm attached to the second pushrod, and an intake valve driven by the second rocker arm. The first rocker arm is longer than the second rocker arm.

16 Claims, 7 Drawing Sheets

U.S. PATENT DOCUMENTS

| | | | | |
|---|---|---|---|---|
| 7,195,094 | B2 | 3/2007 | Street et al. | |
| 7,314,397 | B2 | 1/2008 | Sodemann et al. | |
| 7,418,936 | B2 | 9/2008 | Diggs et al. | |
| 7,617,807 | B2 * | 11/2009 | Diggs et al. | 123/90.48 |
| 2002/0017253 | A1 | 2/2002 | Danesh et al. | |
| 2002/0026918 | A1 | 3/2002 | Durr et al. | |
| 2002/0062805 | A1 | 5/2002 | Durr et al. | |
| 2005/0022768 | A1 | 2/2005 | Tores et al. | |
| 2006/0075979 | A1 | 4/2006 | Grant | |
| 2008/0093862 | A1 | 4/2008 | Brandenburg et al. | |

FOREIGN PATENT DOCUMENTS

| | | | |
|---|---|---|---|
| EP | 1 106 810 | A1 | 6/2001 |
| FR | 2 844 311 | A1 | 3/2004 |
| GB | 2 065 770 | A | 7/1981 |
| GB | 2 448 325 | A | 10/2008 |

OTHER PUBLICATIONS

International Search Report and Written Opinion for Application No. PCT/US2010/042045, mail date Feb. 22, 2011, 16 pages.

* cited by examiner

OVERHEAD VALVE AND ROCKER ARM CONFIGURATION FOR A SMALL ENGINE

BACKGROUND

The present invention relates generally to the field of internal combustion engines. More specifically the present invention relates generally to the field of single-cylinder, four-stroke cycle, internal combustion engines arranged in an overhead valve configuration.

Small engines, such as single-cylinder, four-stroke cycle, internal combustion engines are used with power equipment, such as rotary lawn mowers, pressure washers, home generators, and the like. Some small engines are arranged in an overhead valve (OHV) configuration, with the intake and exhaust valves positioned in the cylinder head.

SUMMARY

One embodiment of the invention relates to a single-cylinder, four-stroke cycle, internal combustion engine arranged in an overhead valve configuration. The engine includes a first valve train and a second valve train. The first valve train includes a first cam on a camshaft, a first pushrod driven by the first cam, a first rocker arm attached to the first pushrod, and an exhaust valve driven by the first rocker arm. The second valve train includes a second cam on the camshaft, a second pushrod driven by the second cam, a second rocker arm attached to the second pushrod, and an intake valve driven by the second rocker arm. The first rocker arm is longer than the second rocker arm.

Another embodiment of the invention relates to a single-cylinder, four-stroke cycle, internal combustion engine arranged in an overhead valve configuration. The engine includes a crankshaft, a camshaft driven by the crankshaft, two pushrods driven by the camshaft, and two rocker arms driven by the pushrods. The rocker arms extend away from the pushrods in directions that are convergent.

Yet another embodiment of the invention relates to a small internal combustion engine arranged in an overhead valve configuration. The engine includes a cylinder head that defines a head of a combustion chamber. The cylinder head includes an intake port on a first side of the cylinder head, and an exhaust port on a second side of the cylinder head. The first side with the intake port is opposite to the second side with the exhaust port. The engine also includes an intake valve and an exhaust valve. The intake and exhaust valves extend through the cylinder head. The combustion chamber receives air passing through the intake valve, where the air is directed from the intake port. The exhaust port receives exhaust directed from the combustion chamber, through the exhaust valve. The head of the combustion chamber includes a first half and a second half. The first half is closer to the intake port than the second half is to the intake port. The exhaust valve is located on the second half of the head of the combustion chamber.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
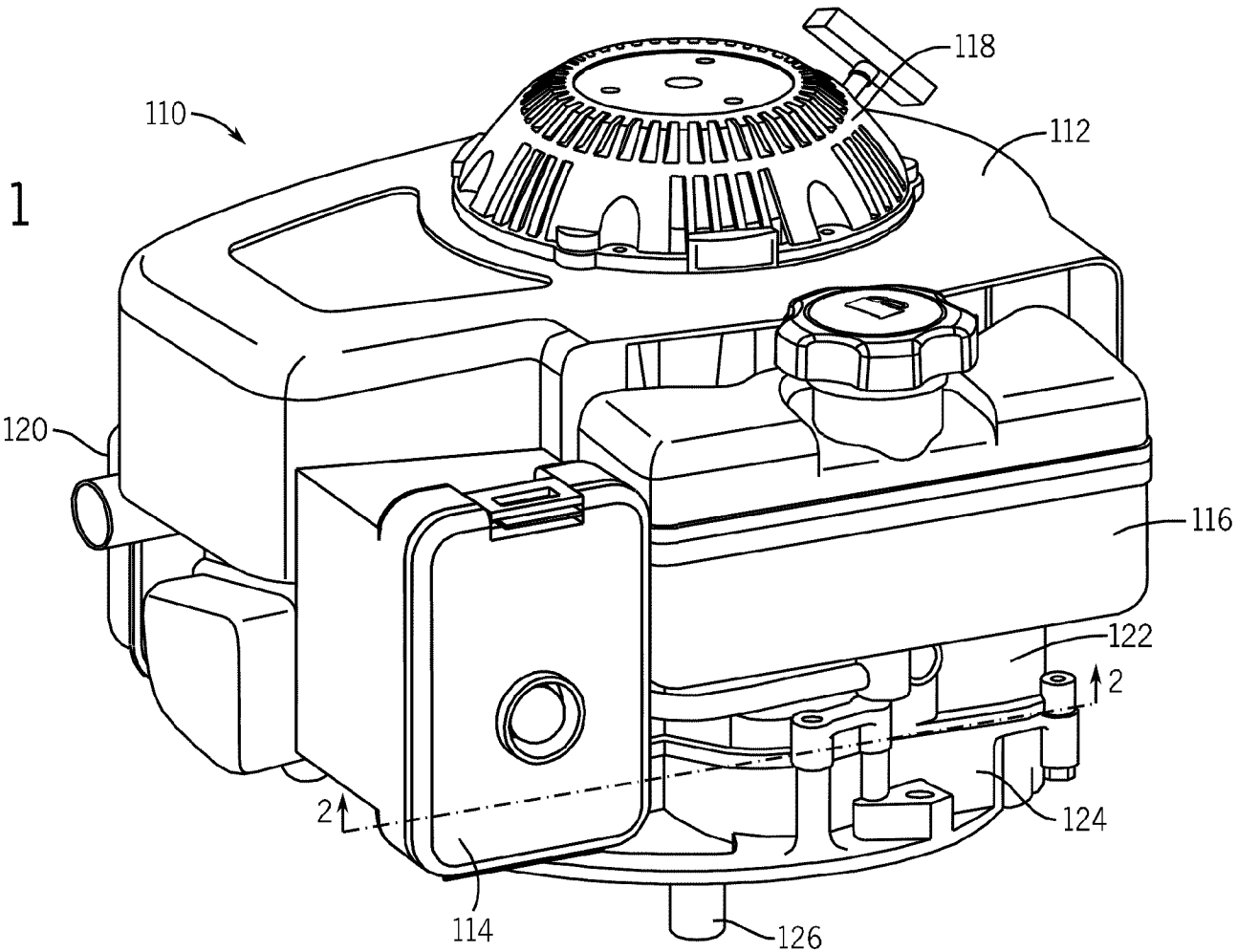
FIG. 1 is a perspective view of an internal combustion engine according to an exemplary embodiment.

Referring to FIG. 1, an internal combustion engine 110 is shown according to an exemplary embodiment. The engine 110 includes a blower housing 112 covering a top of the engine 110. The blower housing 112 surrounds moving engine components, such as a flywheel, a blower fan, and other components. A recoil starter 118 is attached to the top of the blower housing 112, while in other embodiments the engine includes an automatic starter. An air intake 114, a muffler 120, and a fuel tank 116 are mounted to sides of the engine 110. Fuel from the fuel tank 116 is mixed with air entering the intake 114, the fuel and air mixture is then ignited within the engine 110, and exhaust gases exit the engine 110 through the muffler 120. The engine 110 further includes a crankcase 122 and a sump 124 fastened to an underside of the crankcase 122. In other embodiments, the sump 124 and the crankcase 122 may be integrally formed. A vertical crankshaft 126 extends from the crankcase 122, through the sump 124, and may be used to drive power equipment, such as a rotary lawn mower blade, a pressure washer pump, a home power generator, or other equipment. In other embodiments, the engine 110 includes a horizontal crankshaft.

Figure 2:
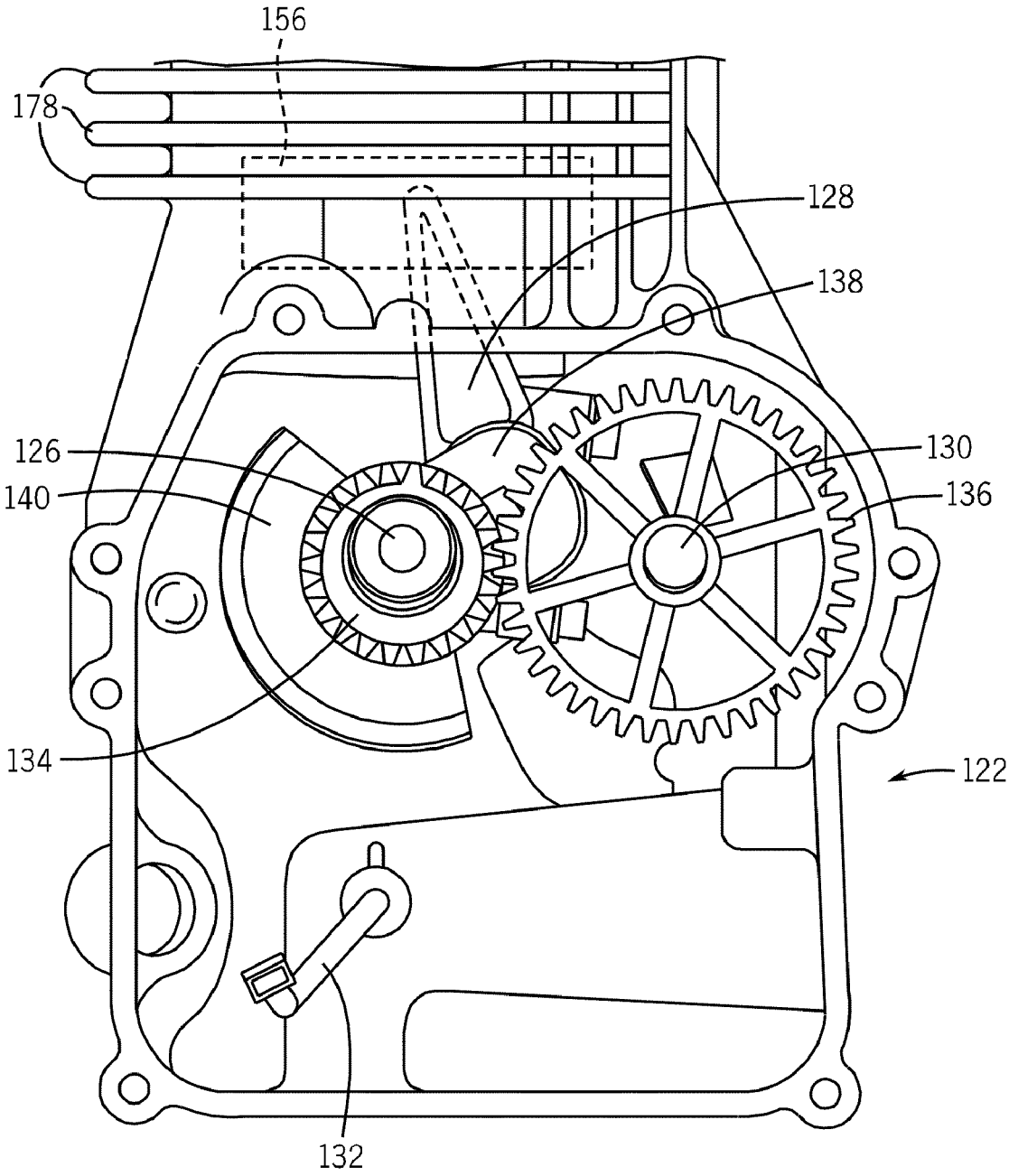
FIG. 2 is a side view of the interior portion of a crankcase and a cylinder block according to an exemplary embodiment.
Figure 3:
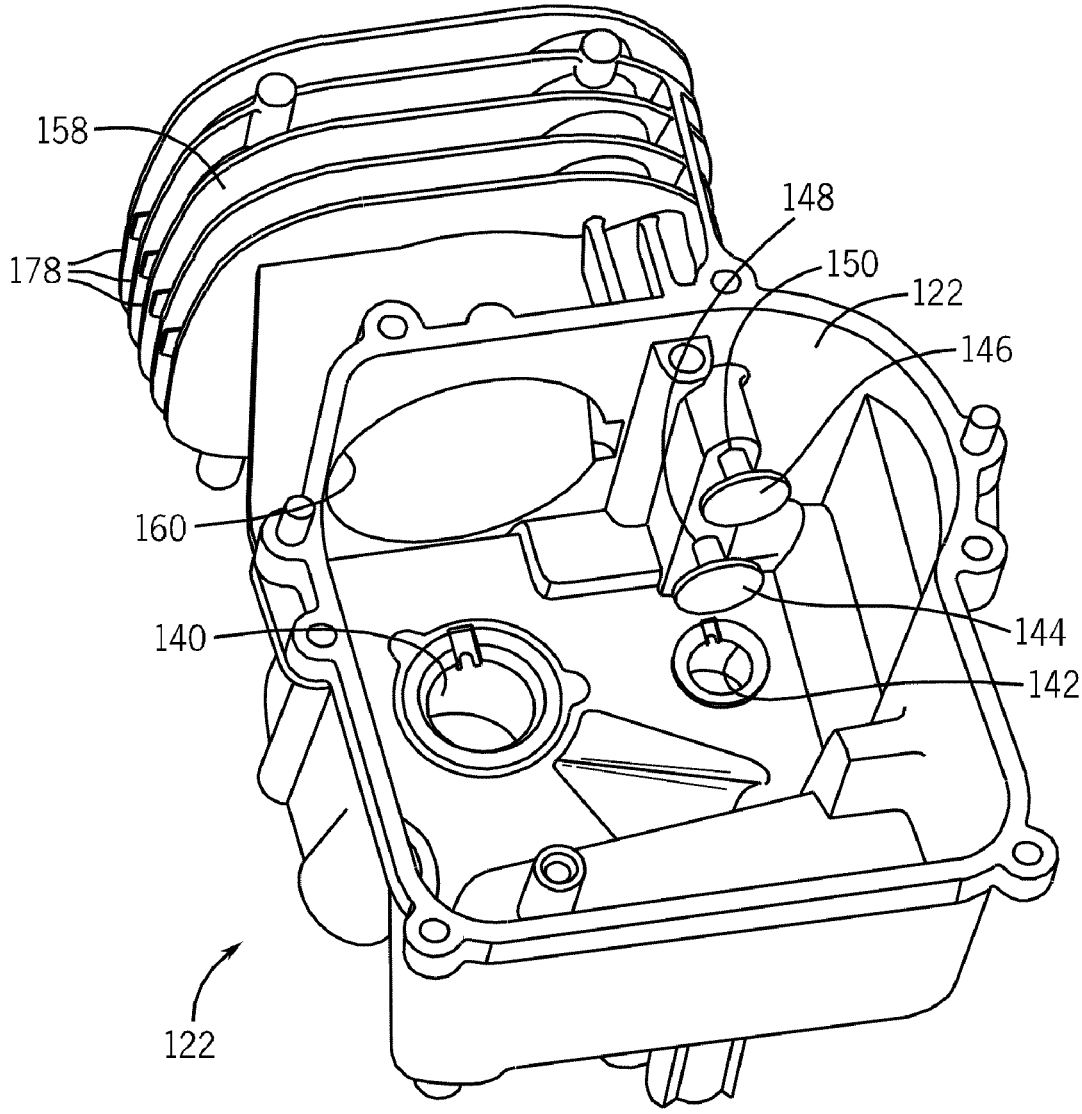
FIG. 3 is a perspective view of the crankcase and cylinder block of FIG. 2.

Referring to FIGS. 2-3, the crankcase 122 supports internal components of the engine 110, such as the crankshaft 126, a connecting rod 128, a camshaft 130, a dipper or slinger 132, and other components. As shown in FIG. 2, the crankshaft 126 and the camshaft 134 include mating gears 134, 136, where rotation of the crankshaft 126 rotates of the camshaft 130. In other embodiments, the crankshaft 126 engages the camshaft 130 with other types of gearing, sprockets, or pulleys. Also shown in FIG. 2, the crankshaft 126 further includes webs 138, a counterweight 140, and a crankpin journal coupled to the connecting rod 128. The connecting rod 128 links the crankshaft 126 to a piston 156.

Still referring to FIGS. 2-3, a cylinder block 158 is coupled to a top of the crankcase 122. A cylinder 160 extends within the cylinder block 158, through which the piston 156 translates between a top dead center position to a bottom dead center position. Movement of the piston 156 rotates the crankshaft 126, and in turn the camshaft 130. Rotation of the camshaft 130 initiates an overhead valve train of linked components that control timed movements of intake and exhaust valves 152, 154. In the embodiment shown in FIG. 2, the crankshaft 126 and the camshaft 130 have parallel axes of rotation, extending longitudinally along the respective shafts.

Referring to FIG. 3, components shown in FIG. 2 are omitted to better show the structure of the crankcase 122. Bushings 140, 142 are formed in a wall of the crankcase 122, which support the crankshaft 126 and camshaft 130, respectively. In other embodiments, bearings are used. Tappets 144, 146 extend from apertures 148, 150 in the crankcase 122. The tappets 144, 146 interface with cams on the camshaft 130, shown in FIG. 2, where the tappets 144, 146 are parts of the overhead valve train. The tappets are attached to pushrods 164, 166 (see FIGS. 4 and 7). Rotation of the camshaft 130 engages the tappets 144, 146 at timed intervals, moving the pushrods 164, 166 vertically through the apertures 148, 150.

Figure 4:
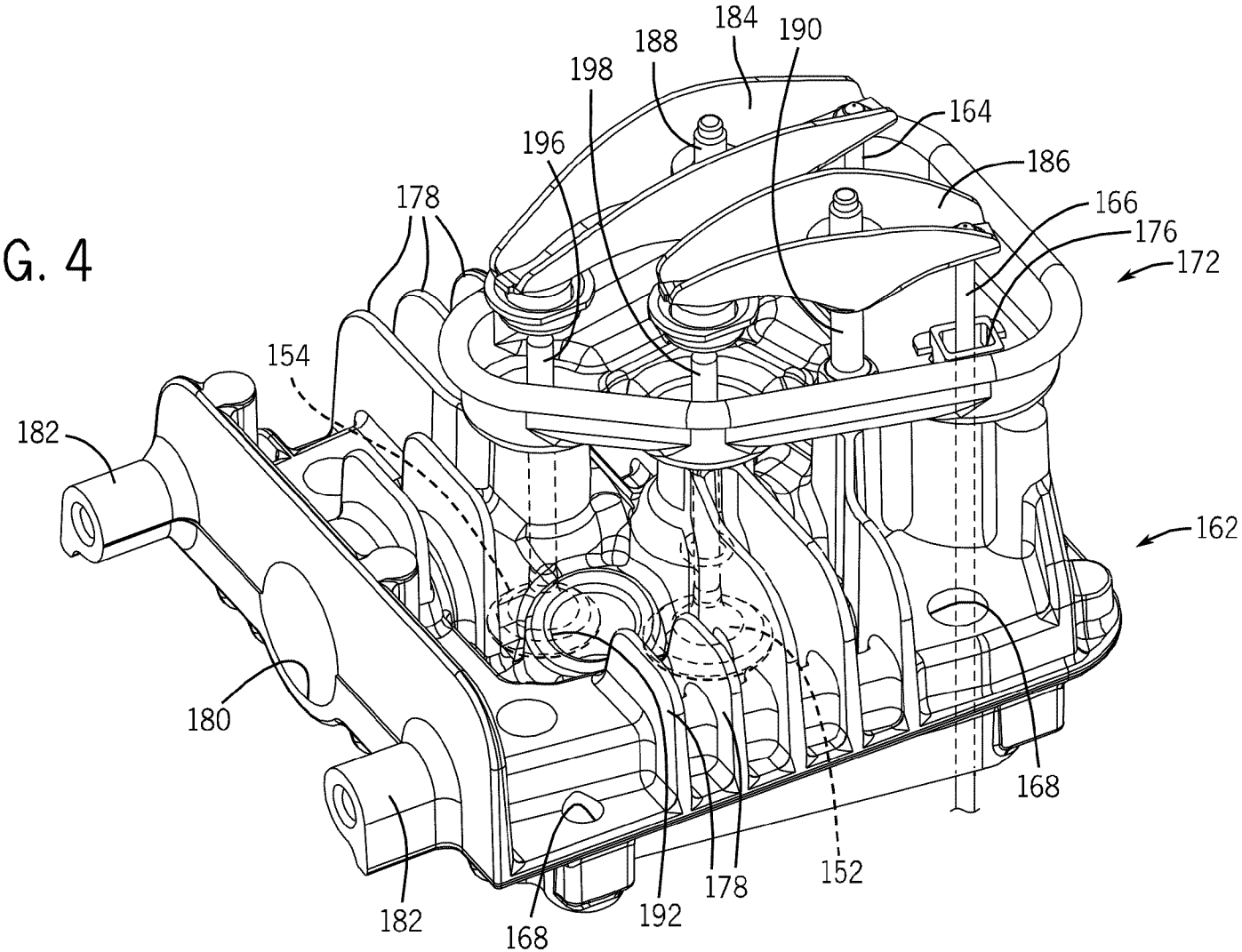
FIG. 4 is a perspective view of a cylinder head according to an exemplary embodiment.
Figure 5:
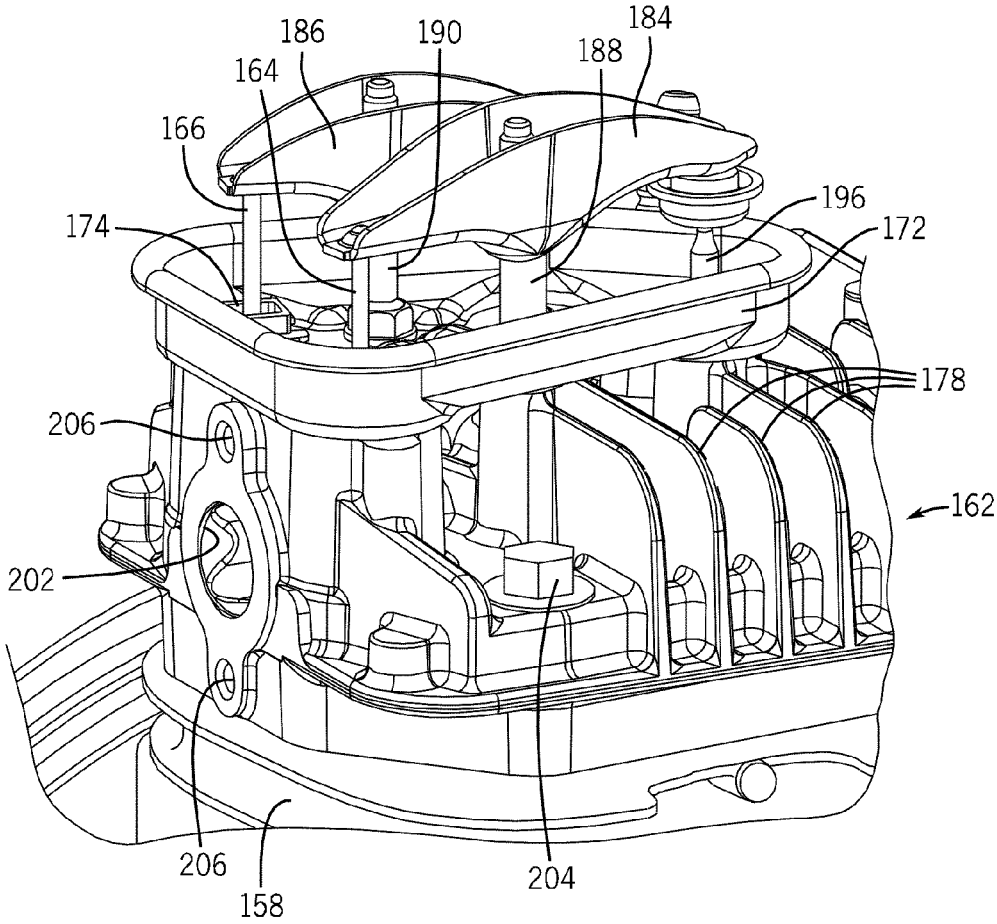
FIG. 5 is another perspective view of the cylinder head of FIG. 4.

Referring to FIG. 4-5, a cylinder head 162 includes apertures 168 for fastening the cylinder head 162 to the top of the cylinder block 158. The cylinder head 162 includes fins 178 that increase surface area for increased convective heat transfer to passing air. A head plate 172 is fastened to the top of the cylinder head 162 with bolts 204. The pushrods 164, 166 extend through the cylinder block 158, the cylinder head 162, and the apertures 174, 176 in the head plate 172.

FIG. 4 shows an exhaust port 180 formed in a side of the cylinder head 162. The exhaust port is configured to be coupled to the muffler 120 (see FIG. 1), where exhaust gases and noise from combustion exit from the engine 110. Bosses 182 may be used to fasten the muffler 120 to the cylinder head 162. In other embodiments, the exhaust port 180 is formed in the cylinder block 158 or other parts of the engine. An aperture 192 allows a spark plug 194 (see FIG. 6) to be inserted through the cylinder head 162 and into the combustion chamber.

FIG. 5 shows an intake port 202 formed in a side of the cylinder head 162, with apertures 206 for fastening an air intake 114 (see FIG. 1) and air filter to the cylinder head 162. The intake port 202 is on a side of the cylinder head 162 that is opposite to the side on which the exhaust port 180 is formed. Fresh air enters the engine 110 and is directed toward the combustion chamber. In some embodiments, the fresh air passes through a carburetor to collect fuel for combustion. In other embodiments, fuel injectors may be used. Prior to entering the combustion chamber, the fuel and air mixture pass through the intake valve 152.

Still referring the FIGS. 4-5, the head plate 172 supports several components of the overhead valve train, including the pushrods 164, 166, rocker arms 184, 186, rocker studs 188, 190, and valve stems 196, 198 coupled to the intake valve 152 and the exhaust valve 154, respectively. The pushrods 164, 166 (i.e., longitudinal axes) are parallel to the valve stems 196, 198, reducing stresses on the rocker arms 184, 186 and the rocker studs 188, 190. However, in other embodiments a longitudinal axis of a pushrod may be planar with a valve stem of the same valve train, but not parallel. In embodiments employing cylindrical pivots a pushrod may be offset from a valve stem, such that the pushrod and the valve stem are neither parallel nor planer.

The rocker arm 184 for the exhaust valve 154 is longer than the rocker arm 186 for the intake valve 152. Further, the rocker arms 184, 186 are inwardly rotated such that lines extending along the length of the rocker arms 184, 186, from the push rods 164, 166 to the valve stems 196, 198, are convergent, and intersect in the direction of the exhaust port 180. The length and angling of the rocker arms 184, 186, allow for a forward exhaust valve 154 in the combustion chamber (see also FIG. 5), where the exhaust valve 154 is positioned closer to the exhaust port 180, shortening the port path from the combustion chamber to the muffler 120.

Figure 6:
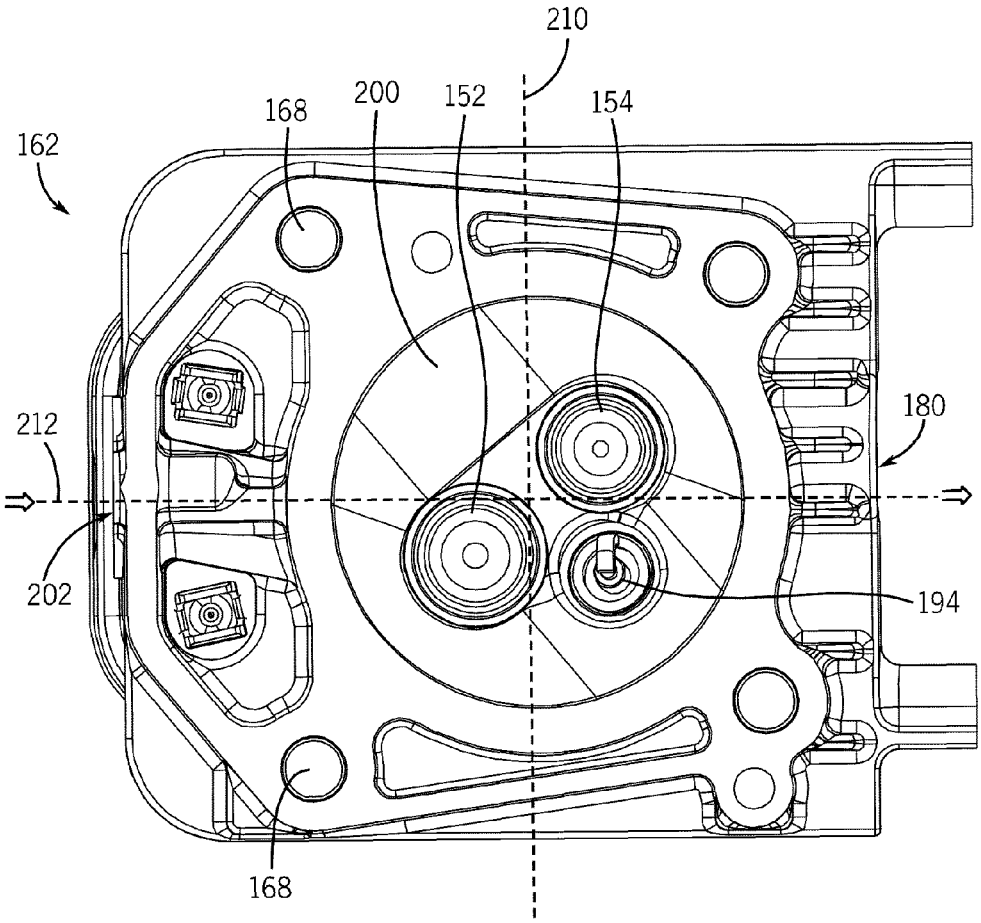
FIG. 6 is a bottom view of the cylinder head of FIG. 4.

Referring to FIG. 6, on an underside of the cylinder head 162 a head 200 of the combustion chamber is shown according to an exemplary embodiment. The cylinder 160, the piston 156, and the head 200 together form the combustion chamber of the engine 110. The overhead valves 152, 154 are positioned in the head 200, and the overhead valve train controls the opening and closing of the overhead valves 152, 154.

As shown in FIG. 6, the head 200 of the combustion chamber has a circular profile, where the head 200 may form a hemispheric top to the combustion chamber. The circular profile may be divided into even halves, with a first half closer to the exhaust port 180 (see FIG. 4) and a second half closer to the intake port 202 (see FIG. 5). Arrows in FIG. 6 indicate the direction of air flowing into the intake port 202 and exhaust flowing out of the exhaust port 180. The halves may be divided by splitting the circle along a first line 210 that is perpendicular to a second line 212 extending from the intake port 202 to the exhaust port 180. So divided, the exhaust valve 154 is positioned primarily within the first half and the intake valve 152 is positioned primarily within the second half. The ground electrode of the spark plug 194 is positioned primarily in the first half. Locating the overhead valves 152, 154 and the spark plug 194 as shown in FIG. 6 may reduce the length of an air flow path through the engine, reducing drag. Additionally, the configuration shown in FIG. 6 may reduce the loses caused by changing momentum of the air flow. For example, in one embodiment, the air flow path extends from the intake port 202 to the exhaust port 180 without substantially reversing direction, with the exception of movements of air within the combustion chamber.

Referring to FIG. 6, the overhead valves 152, 154 are arranged such that the exhaust valve 154 and the spark plug 194 are positioned closer to the exhaust port 180 (see FIG. 4) than the intake valve 152 is to the exhaust port 180. The exhaust valve 154 is closer to the exhaust port 180 than the spark plug 194 is to the exhaust port 180. The spark plug 194 is closer to the exhaust valve 154 than the intake valve 152 is to the exhaust valve 154. Also, the spark plug 194 is approximately equidistant from the exhaust valve 154 and the intake valve 152. The positioning of the intake valve 152, the exhaust valve 154, and the spark plug 194, relative to the exhaust port 180 and to each other, is intended to improve engine efficiency by reducing changes to the momentum and decreasing the travel distance of air flow through the engine 110.

In some embodiments, the center of the exhaust valve 154 is positioned at least a quarter inch closer to the exhaust port 180 than the center of the intake valve 152, preferably at least a half inch. As shown in FIG. 6, the exhaust valve 154 is positioned greater than thirty degrees, forward (i.e., toward the exhaust port 180) from the intake valve 152, when measured relative to the first line 210 that is perpendicular to the second line 212 extending between the intake port 202 and the exhaust port 180. The spark plug 194 is positioned still further forward from the intake valve 152. In some exemplary embodiments, the spark plug is at least sixty degrees, relative to the first line 210, forward from the intake valve 152. Forward positioning of the spark plug 194 and the intake valve 152 allows for momentum of the fuel and air mixture entering the combustion chamber to carry the mixture toward the center of the combustion chamber. Additionally, the ground electrode is positioned near the center of the combustion chamber, enhancing burn efficiency.

As shown, the valves 152, 154 have disc-shaped or circular heads, with the intake valve 152 having a greater diameter than the exhaust valve 154. The mass of the exhaust valve train, including the smaller diameter exhaust valve 154 and the longer rocker arm 184, is approximately equal to the mass of the intake valve train, which allows for the use of common valve springs that fit the requirements of both valve trains. Additionally, having valve trains with approximately equal masses allows for the valve trains to be configured with similar aggressiveness (i.e., the rate of responsiveness in opening and closing). In some embodiments, due to the approximately equal valve train masses, the camshaft 130 (see FIGS. 2-3) includes cams with similar profiles for each valve train. In an alternate embodiment, the varying lengths of the rocker arms 184, 186 may account for the different masses of the valves 152, 154, such that, during engine operation, torque experienced on the camshaft 130 is evenly distributed with respect to rotation angle of the camshaft 130. In other embodiments, the torque may not be evenly distributed, but the length of the rocker arms provides for a smooth transition between the cams on the camshaft 130.

Figure 7:
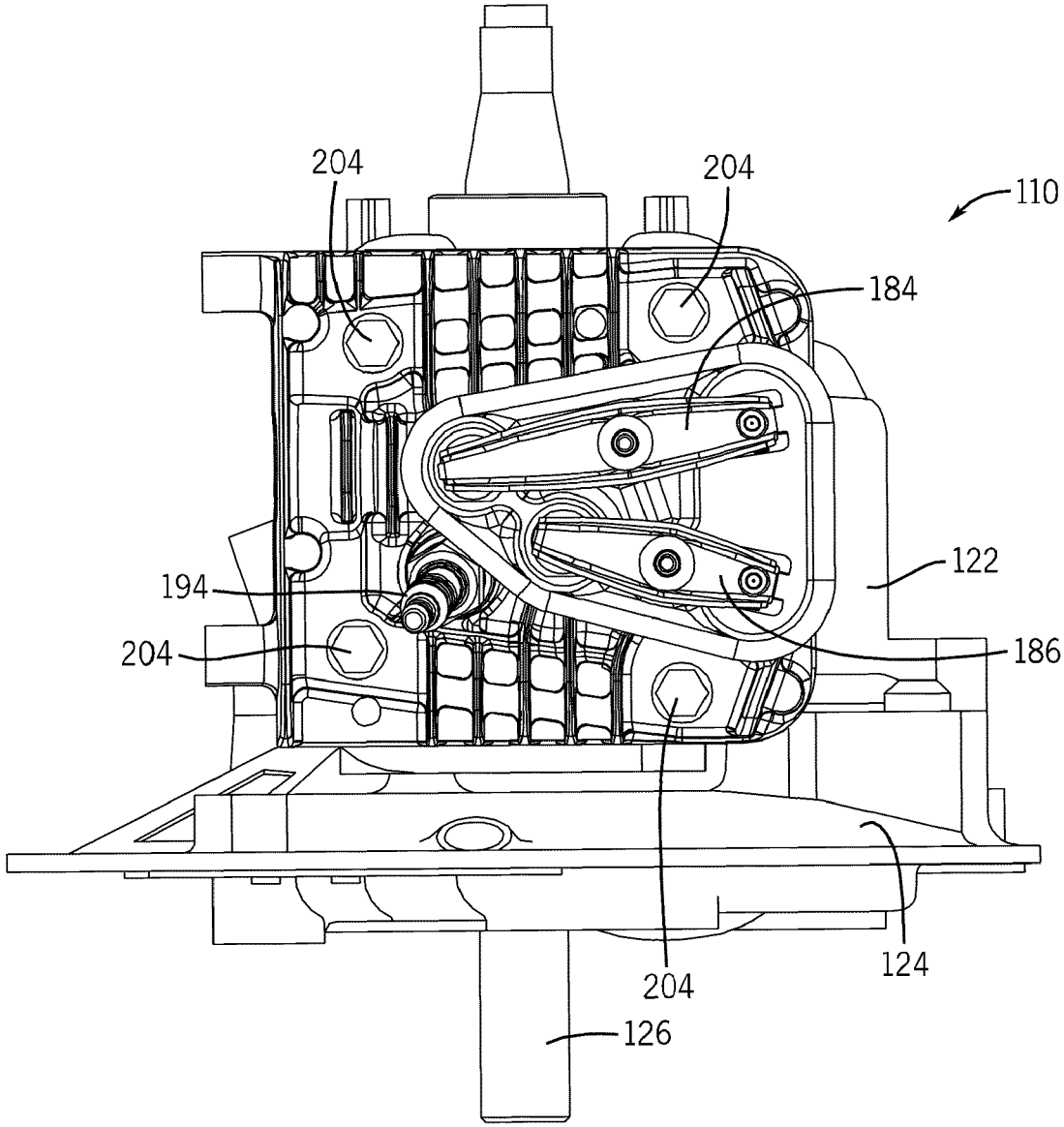
FIG. 7 is a side view of a cylinder head according to an exemplary embodiment.

Referring to FIG. 7, during engine operation, the four-stroke combustion process results in two rotations of the crankshaft 126 for each cycle. The intake valve 152 (see FIGS. 4 and 5), coupled to the shorter rocker arm 186, opens and the piston 156 (see FIG. 2) moves from top dead center within the cylinder 160 (see FIG. 3) to bottom dead center. The movement results in an intake of fuel and air into the combustion chamber. The intake valve 152 then closes and the piston 156 (see FIG. 2) moves back to top dead center, compressing the fuel and air. The compressed fuel and air are then ignited by the spark plug 194, driving the piston back to bottom dead center. This motion pushes the connecting rod 128 (see FIG. 2), and adds rotational force to the crankshaft 126. The exhaust valve 154 (see FIGS. 4 and 5) in the combustion chamber then opens, and stored rotational momentum in a flywheel drives the piston back to top dead center. This movement pushes exhaust gases (i.e., spent fuel and air) from the combustion chamber and out the exhaust port 180 (see FIG. 4). The sequence of strokes then repeats.

The construction and arrangements of the internal combustion engine, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. In some embodiments, the engine may include more than a single cylinder, such as a double- or triple-cylinder engine for use with a lawn tractor. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A single-cylinder four-stroke internal combustion engine arranged in an overhead valve configuration, comprising:

a first valve train comprising
- a first cam on a camshaft;
- a first pushrod driven by the first cam;
- a first rocker arm coupled to the first pushrod; and
- an exhaust valve driven by the first rocker arm;

a second valve train comprising
- a second cam on the camshaft;
- a second pushrod driven by the second cam;
- a second rocker arm coupled to the second pushrod; and
- an intake valve driven by the second rocker arm;

wherein the first rocker arm is longer than the second rocker arm;

a cylinder head having an exhaust port on a side of the cylinder head, the exhaust port configured to be coupled to a muffler, wherein the exhaust valve is closer to the exhaust port than the intake valve is to the exhaust port; and a spark plug inserted through the cylinder head, wherein the spark plug is closer to the exhaust port than the intake valve is to the exhaust port.

2. The engine of claim 1, wherein the exhaust valve is closer to the exhaust port than the spark plug is to the exhaust port.

3. The engine of claim 1, wherein the spark plug is closer to the exhaust valve than the intake valve is to the exhaust valve.

4. The engine of claim 3, wherein the spark plug is equidistant from the exhaust valve and from the intake valve.

5. The engine of claim 1, wherein the intake valve has a circular valve head and the exhaust valve has a circular valve head, wherein the intake valve head has a wider diameter than the exhaust valve head.

6. The engine of claim 5, wherein the mass of the first valve train is equal to the mass of the second valve train.

7. The engine of claim 1, wherein the exhaust valve and the intake valve comprise valve stems having longitudinal axes extending in parallel directions away from the first rocker arm and the second rocker arm, respectively; and wherein the longitudinal axis of the first pushrod extends away from camshaft in a parallel direction with the longitudinal axis of the second pushrod.

8. The engine of claim 7, wherein a plane defined by the longitudinal axes of the pushrods intersects a plane defined by the longitudinal axes of the valve stems.

9. The engine of claim 1, wherein the intake valve has a valve stem and the exhaust valve has a valve stem, wherein the valve stems extend in parallel directions.

10. The engine of claim 9, wherein a plane defined by the longitudinal axes of the valve stems intersects a plane defined by the longitudinal axes of the pushrods.

11. A small internal combustion engine arranged in an overhead valve configuration, the engine comprising:

a cylinder head defining a head of a combustion chamber, the cylinder head comprising an intake port on a first side of the cylinder head and an exhaust port on a second side of the cylinder head, wherein the first side is opposite to the second side; and an intake valve and an exhaust valve extending through the cylinder head;

wherein the combustion chamber receives air passing through the intake valve directed from the intake port, and wherein the exhaust port receives exhaust directed from the combustion chamber through the exhaust valve;

wherein the head of the combustion chamber includes a first half and a second half, wherein the first half is closer to the intake port than the second half is to the intake port, wherein the exhaust valve is located on the second half of the head of the combustion chamber.

12. The engine of claim 11, wherein the head of the combustion chamber has a circular profile, and wherein the first half and second half are separated along a first line that is perpendicular to a second line, the second line extending between the intake port and the exhaust port.

13. The engine of claim 12, wherein the intake valve is located on the first half of the head of the combustion chamber.

14. The engine of claim 13, wherein the center of the exhaust valve is located at least thirty degrees relative to the first line toward the exhaust port from the center of the intake valve.

15. The engine of claim 14, further comprising a spark plug extending from the head of the combustion chamber, wherein the spark plug is located on the second half of the head of the combustion chamber.

16. The engine of claim 15, wherein a ground electrode of a spark plug is located at least sixty degrees relative to the first line toward the exhaust port from the center of the intake valve.

* * * * *